US008689802B2

(12) United States Patent
Schoenfeld

(10) Patent No.: US 8,689,802 B2
(45) Date of Patent: Apr. 8, 2014

(54) COMBINATION SMOKING AND DRINKING APPARATUS

(76) Inventor: Alexander C. Schoenfeld, Albuquerque, NM (US)

( * ) Notice: Subject to any disclaimer, the term of this patent is extended or adjusted under 35 U.S.C. 154(b) by 65 days.

(21) Appl. No.: 13/329,058

(22) Filed: Dec. 16, 2011

(65) Prior Publication Data

US 2012/0152263 A1 Jun. 21, 2012

Related U.S. Application Data

(60) Provisional application No. 61/424,385, filed on Dec. 17, 2010.

(51) Int. Cl.
*A24F 3/00* (2006.01)

(52) U.S. Cl.
USPC ..... 131/178; 215/13.1; 220/592.17

(58) Field of Classification Search
USPC ..... 131/178
See application file for complete search history.

(56) References Cited

U.S. PATENT DOCUMENTS 4,198,993 A * 4/1980 Martin et al. ..... 131/173
6,505,752 B1 * 1/2003 Rolfes et al. ..... 220/592.16
2004/0202751 A1 * 10/2004 McKay et al. ..... 426/112

* cited by examiner

*Primary Examiner* — Joseph S Del Sole
*Assistant Examiner* — Eric Yaary
(74) *Attorney, Agent, or Firm* — Lowry Blixseth LLP; Scott M. Lowry

(57) ABSTRACT

The combination smoking and drinking apparatus includes a generally upright consumable liquid retaining container with an elongated conduit formed therebetween. An inlet is coupled to one end of the conduit and has a combustion compartment therein. Additionally, an outlet is coupled to an opposite end of the conduit such that applying a vacuum to the outlet pressurizes the conduit and draws smoke from the combustion compartment directly through the conduit to the outlet without mixing the smoke with the consumable liquid in the container.

19 Claims, 8 Drawing Sheets

COMBINATION SMOKING AND DRINKING APPARATUS

BACKGROUND OF THE INVENTION

The present invention relates to a combination smoking and drinking apparatus. More particularly, the invention relates to a combination smoking and drinking apparatus that enables users to simultaneously handle a beverage consumption device and a smoking device.

Smoking has been ubiquitous among various human cultures for many years. In general, the process involves inhaling a concentration of smoke generated from burning dried leaves. Accordingly, over the years, various devices have been developed to concentrate the smoke for inhalation. Such smoking devices usually include a small chamber, oftentimes called a "bowl", where combustion of the dried leaves takes place. Smoke travels from the bowl through a stem portion to a mouth piece. The vacuum created at the mouth piece when inhaling causes the smoke burning at the bowl to be drawn through the stem and to the user.

Oftentimes devices used for smoking and beverage consumption are used in similar settings. For example, users may endeavor to use smoking devices and beverage consumption devices in the morning (e.g., at breakfast), during the day (e.g., during a smoking break) or even in social settings. The problem is that users are required to juggle the beverage consumption device and the smoking device (e.g., a lighter and pipe) all at the same time. Pipes and other comparable smoking devices may require repeated lifting, movement and setting down along with shuffling the beverage consumption device when both devices are used in the same setting. As such, this activity is not only inconvenient, but it also necessitates constant movement of the smoking and beverage consumption devices. This enhances the potential that one or both of the devices may be dropped, tipped, spilled or otherwise broken due to repeated handling.

One such known combination smoking and drinking article known in the art is disclosed in U.S. Pat. No. 4,198,993 to Martin et al. Martin discloses such an article that generally includes an inner shell that forms a reservoir for holding a beverage and a surrounding outer shell having smoke input and output means. A rather large smoke chamber for containing a smoke filtering agent (e.g., water) is formed between the inner and outer shells. This chamber is rather large and fails to accommodate direct travel from the inlet to the outlet as a result of failing to define any such conduit or channel. As such, smoke in this chamber can become stagnant due to a lack of pressure therein. Furthermore, Martin teaches the use of materials that allow the inner shell to serve as a means for conducting heat between the chamber and the beverage retaining reservoir to provide auxiliary cooling of the smoke. This too is undesirable in that heat exchange between the beverage and the smoke can unduly change the temperature of the beverage or the smoke.

There exists, therefore, a significant need for a combination smoking and drinking apparatus that integrates an efficient smoking device with a beverage consumption device. Such a combination smoking and drinking apparatus should include an insulated container for housing a beverage, a means for consuming the beverage in that container, and an integral smoking device that generally includes bowl, a stem and a mouthpiece for directly channeling smoke from a combustion compartment at the inlet to the outlet for inhalation. The present invention fulfills these needs and provides further related advantages.

SUMMARY OF THE INVENTION

The combination smoking and drinking apparatus disclosed herein includes a generally upright consumable liquid retaining container. An elongated conduit is formed between an inner and an outer wall of the container. An inlet is coupled to one end of the conduit and has a combustion compartment therein. The inlet may be configured to selectively receive an insertable bowl. Furthermore, an outlet is coupled to an opposite end of the conduit such that applying a vacuum to the outlet pressurizes the conduit and draws smoke from the combustion compartment directly through the conduit to the outlet without mixing the smoke with the consumable liquid in the container. The outlet preferably includes a mouthpiece formed from a lip of the container.

In one embodiment, the conduit may be configured as a non-liquid retaining conduit. In this embodiment, the inlet or the outlet may be substantially disposed in a common plane with the non-liquid retaining conduit. As such, in this configuration, the inlet or the outlet may drain any liquid out from within the non-liquid retaining conduit as a result of being coplanar. In an alternative embodiment, the conduit may be configured to retain a quantity of water. In this embodiment, the inlet may include a stem that generally extends into the conduit. Preferably, the stem extends into a water reservoir that at least partially fills the conduit.

The combination smoking and drinking apparatus may further include a handle coupled to the container. The handle preferably includes an elongated passageway that bridges the inlet with the outlet via the elongated conduit. In this embodiment, the outlet is preferably externally accessible from the handle. Moreover, the container may be insulated from the elongated conduit to prevent heat transfer between the consumable liquid and the smoke traveling from the inlet to the outlet. In a particularly preferred embodiment, the inlet and the outlet are located on opposite sides of the container. Additionally, a carb may be formed from an exterior portion of the container and be coupled to the conduit. This allows the user to selectively expose the conduit to atmospheric pressure.

In another alternative embodiment, the combination smoking and drinking apparatus may be a wine goblet that includes an upright base having an interior chamber. The consumable liquid retaining container couples to and is generally positioned above the base. The container preferably has a double-walled construction defining a conduit therein. At least one vent couples the interior chamber of the base to the conduit in the container. As such, an externally accessible outlet couples to the container at one end of the conduit and an inlet formed from a portion of the base and including a combustion compartment couples to an opposite end of the interior chamber. In this respect, applying a vacuum to the outlet pressurizes air within the conduit and draws smoke from the combustion compartment through the interior chamber, the at least one vent, and the conduit to the outlet without mixing the smoke with the consumable liquid in the container. Preferably, the container is thermally insulated from the conduit to prevent heat transfer between the consumable liquid and the smoke travelling therethrough.

The inlet may include a bowl having a stem disposed therein and configured to extend into the interior chamber of the base. In the event the interior chamber includes water, the stem is preferably sized to extend into the water reservoir. The interior chamber may include a generally elongated tunnel coupled to an elongated conduit by the at least one vent. An externally accessible carb positioned between the inlet and the outlet and coupled to either of the elongated tunnel or the elongated conduit allows a user to selectively expose the interior chamber or the conduit to atmospheric pressure. In this respect, it is preferred that the carb, the inlet and the outlet be positioned in a common plane to facilitate universal right-handed and left-handed use of the combination smoking and drinking apparatus.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
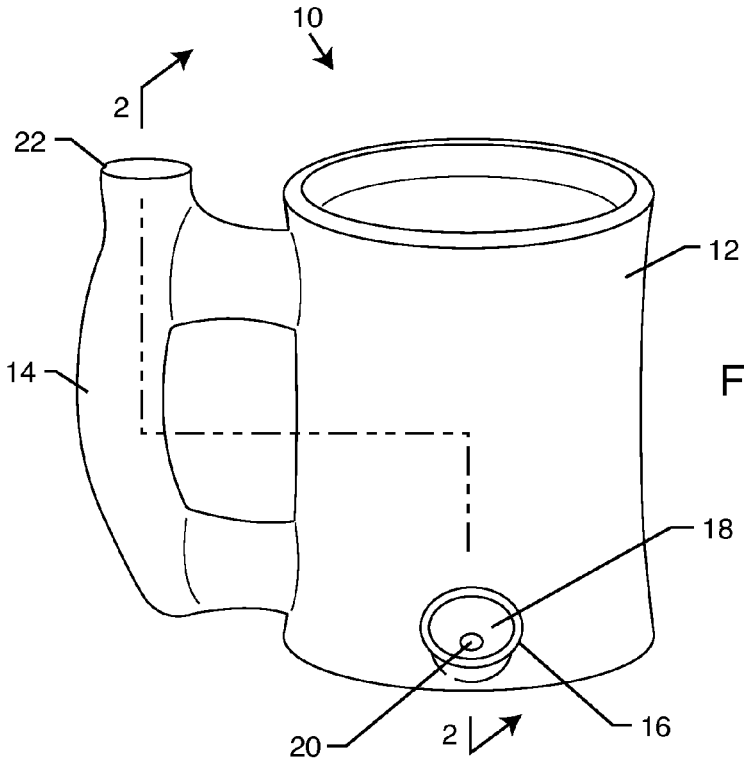
FIG. 1 is a perspective view of a pipe mug in accordance with one embodiment of the combination smoking and drinking apparatus disclosed herein.

As shown in the drawings for purposes of illustration, the present invention for a combination smoking and drinking apparatus is shown in several embodiments in FIGS. 1-18. In FIG. 1, a pipe mug 10 is illustrated having a generally cylindrical container 12 capable of storing consumable liquids. Coupled to the container 12 is a handle 14. The handle 14 enables a user to easily grasp the pipe mug 10, similar to other mugs known in the art. In one embodiment, as described in more detail below with respect to FIG. 2, the handle 14 may make up part of the stem for channeling smoke from some form of inlet orifice to an exit orifice where the smoke can be preferably inhaled. In this respect, FIG. 1 illustrates a bowl 16 externally accessible from the outer surface of the container 12. The bowl 16 includes an inner compartment 18 for housing tobacco or other burnable materials used for smoking. The bowl 16 includes an aperture 20 extending into the interior of the container 12. Accordingly, a user is able to draw smoke from burning materials within the compartment 18 into the interior of the container 12, through the handle 14 and out through a mouthpiece 22, as described in more detail below, by applying a vacuum in and around the mouthpiece 22. For purposes of smoking, a user may create a seal around the mouthpiece 22 and inhale, thereby generating the requisite vacuum to inhale smoke generated from the burning materials in the bowl 16.

Figure 2:
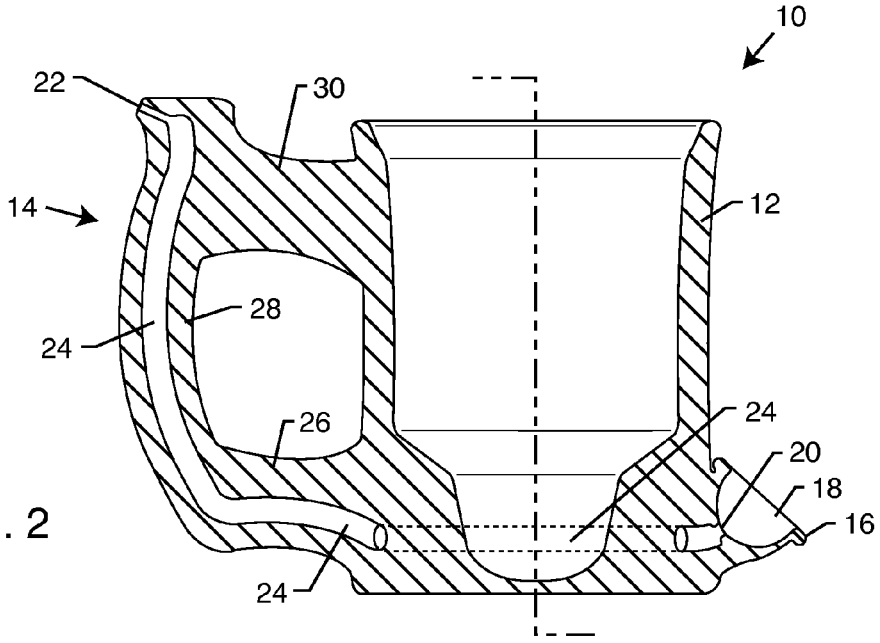
FIG. 2 is a cross-sectional view of the pipe mug, taken about the line 2-2 in FIG. 1.

The cross-sectional view of FIG. 2 further illustrates that the interior of the container 12 is sealed off and separate from a conduit 24 that extends through a bottom portion of the container 12. This ensures that the consumable liquid in the container 12 is not contaminated by any smoke particulates. The conduit 24 continues through a lower horizontal support 26 and up through a vertical element 28 of the handle 14 before coupling to the mouthpiece 22. In this respect, to use the pipe mug 10 shown in FIGS. 1-2 for smoking, a user first places tobacco in the bowl 16. The tobacco is ignited such that smoke is produced. To inhale the smoke, a user creates a vacuum at the outer edge of the mouthpiece 22 by inhaling. Smoke generated at the point of the bowl 16 is drawn into the conduit 24 as a result of the vacuum created at the mouthpiece 22. The conduit 24 forms a hollow ring around the bottom portion of the container 12, extends into the lower horizontal support 26, up through the vertical element 28 and out the mouthpiece 22. The elongated and narrow construction of the conduit 24 ensures maximum and efficient pressurization such that smoke is drawn directly into the mouthpiece 22 when the vacuum is present. This feature is certainly advantageous over prior art devices that use a generally larger smoke chamber and do not otherwise provide a direct line of access or flow from the bowl 16 to the mouthpiece 22.

Of course, the embodiments shown with respect to FIGS. 1-2 are merely preferred embodiments. Alternative embodiments of the pipe mug 10 may include positioning the bowl 16 at different heights or positions along the outer surface of the container 12 or varying the position of the mouthpiece 22. But, the bowl 16 and the mouthpiece 22 are preferably externally accessible. Additionally, the conduit 24 may simply be the ring-type structure depicted in FIG. 2, or the conduit 24 may travel through other horizontal or vertical chambers/elements of the container 12, such as through an upper horizontal support 30 in the handle 14.

Figure 3:
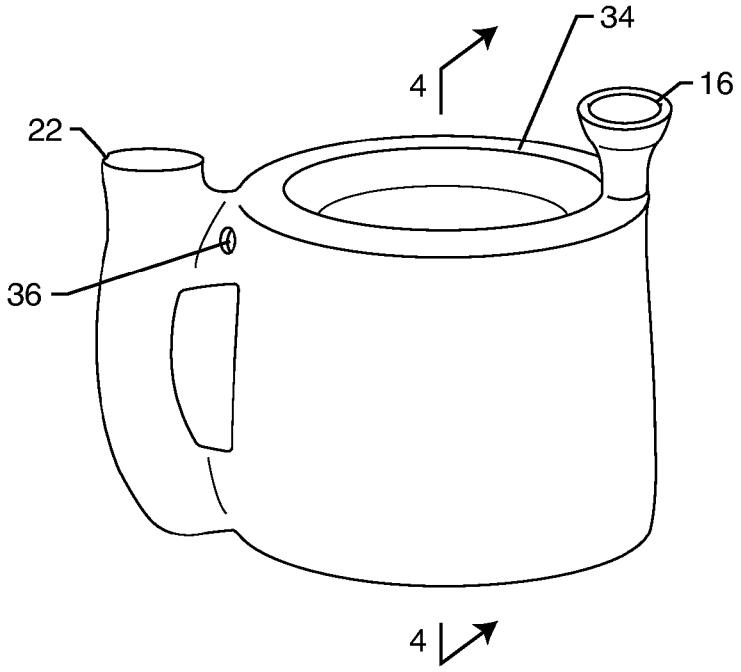
FIG. 3 is a perspective view of an alternative pipe mug in accordance with another embodiment of the combination smoking and drinking apparatus.
Figure 4:
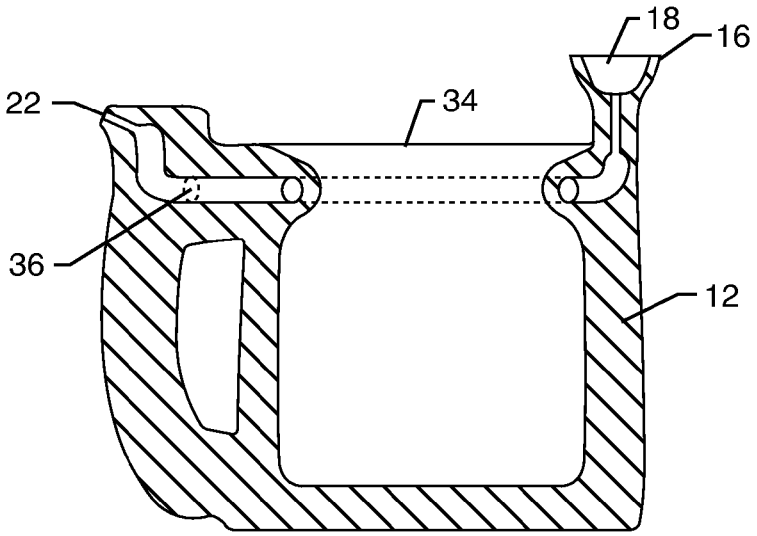
FIG. 4 is a cross-sectional view of the alternative pipe mug, taken about the line 4-4 in FIG. 3.

FIGS. 3-4 illustrate one such alternative embodiment of the pipe mug 10 wherein the bowl 16 and the conduit 24 (FIG. 4) are formed along a common upper portion of the container 12. This embodiment, like the embodiment described above with respect to FIGS. 1-2, is particularly preferred as the conduit 24 provides a direct access tunnel from the bowl 16 to the mouthpiece 22. Similarly, locating the bowl 16 or the mouthpiece 22 along a common horizontal plane as the conduit 24 further facilitates efficient movement of the smoke generated at the bowl 16 through the conduit 24 and to the mouthpiece 22. Although, the embodiments illustrated in FIGS. 1-4 are particularly incompatible with water reservoirs, as used by some devices known in the art, as the water therein would restrict and clog the efficient flow of smoke from the bowl 16 to the mouthpiece 22. As mentioned above, the elongated tunnel-like shape of the conduit 22 facilitates increased pressurization therein and water or other unwanted particulates in the conduit 24 would be inhaled by the user 22, if present.

Figure 5:
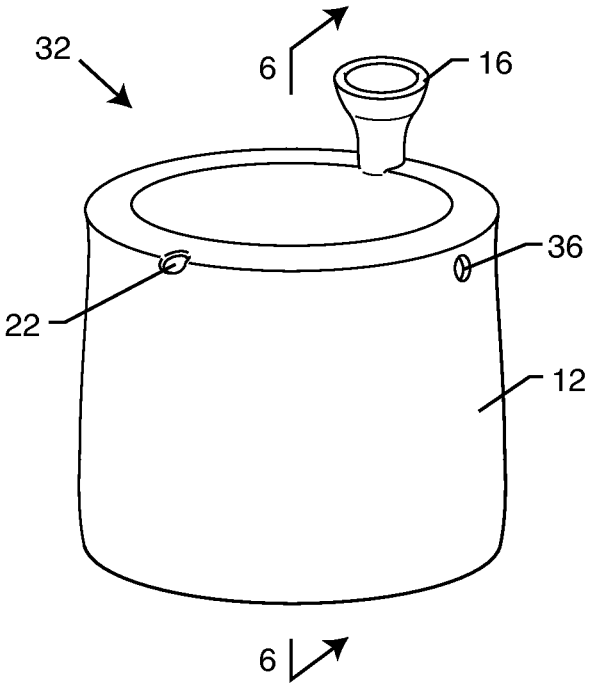
FIG. 5 is a perspective view of an alternative combination smoking and drinking apparatus in the form of a cup.
Figure 6:
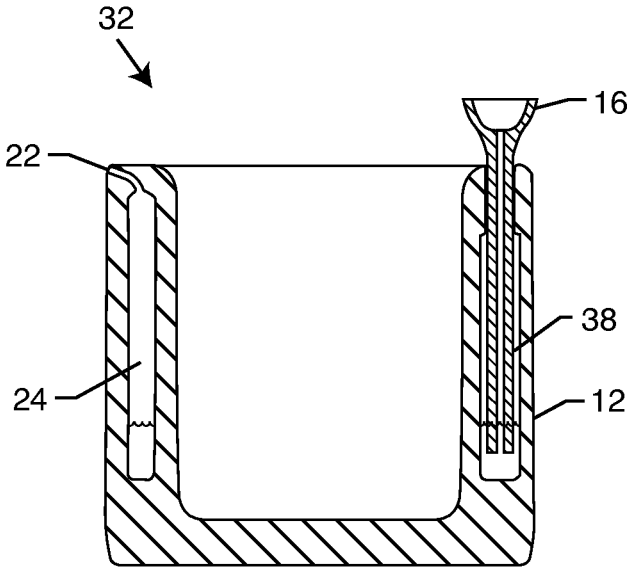
FIG. 6 is a cross-sectional view of the cup, taken about the line 6-6 in FIG. 5.

FIGS. 5-6 illustrate an alternative embodiment of the combination smoking and drinking apparatus as described above. Here, the combination smoking and drinking apparatus is in the form a cup 32. The cup 32 includes the container 12 for storing a consumable liquid. The cup 32 also includes the bowl 16 for retaining and burning tobacco. Smoke generated as a result of burning the tobacco is funneled through the bowl 16 and into the conduit 24. In this embodiment, the conduit 24 may reside along a lower portion of the cup 32 (similar to FIGS. 1-2), along an upper portion or a lip 34 of the cup 32 (similar to FIGS. 3-4), or, less preferably, the conduit 24 may form the generally elongated conduit 24 shown in FIG. 6. In this embodiment, the cup 32 omits the handle 14 of the pipe mug 10. As a result, the mouthpiece 22 is preferably formed out of or along the lip 34.

Furthermore, FIG. 5 illustrates a carb 36 in the exterior of the cup 32 that provides access to the conduit 24. The carb 36 is designed so that the conduit 24 may be selectively exposed to atmospheric air pressure. With the carb 36, the user may permit or prevent access to the conduit 24 by simply selectively covering or opening the carb 36 to the atmosphere. Opening the conduit 24 to the atmosphere through the carb 36 provides more efficient evacuation of smoke within the conduit 24 during inhalation by drawing in atmospheric air. When the carb 36 is not present, the conduit 24 may be exposed to the atmosphere, in some embodiments described herein, by at least partially withdrawing the bowl 16 out from within the conduit 24 (as opposed to operating the carb 36).

FIG. 6 further illustrates an elongated bowl 16 that includes a shaft 38 that extends into the conduit 24. The bowl 16 may be formed as part of the container 12, as shown in FIG. 6, or it may be separate. If the bowl 16 is separate, it is preferably selectively removable out from within the interior of the conduit 24 to facilitate pressurized movement of smoke in the conduit 24 as a result of being exposed to atmospheric pressure, as described above. Accordingly, FIG. 6 also illustrates that the conduit 24 extends approximately the height of the container 12. In past embodiments, the conduit 24 has simply been a small channel or tunnel formed from a portion of the container 12. As a result, the elongated shaft 38 of the bowl 16 extends approximately the height of the container 12. The extended length of the shaft 38 ensures that smoke drawn in from the bowl 16 enters the conduit 24 for travel to the mouthpiece 22. The conduit 24 shown in FIG. 6 is partially filled with water such that the shaft 38 extends therein. Smoke drawn or pulled into the conduit 24 must first travel from the bowl 16, through the shaft 38 and into the water reservoir before percolating out therefrom to be inhaled through the mouthpiece 22. Preferably the level of the water reservoir does not go to the top of the conduit 24 so that the smoke may percolate out from the water before being inhaled. This ensures that the user does not inhale the water. This design functions similar to a water pipe. The bowl 16 depicted in FIG. 6 is also preferably selectively removable and/or replaceable out from within the interior of the conduit 24.

Figure 7:
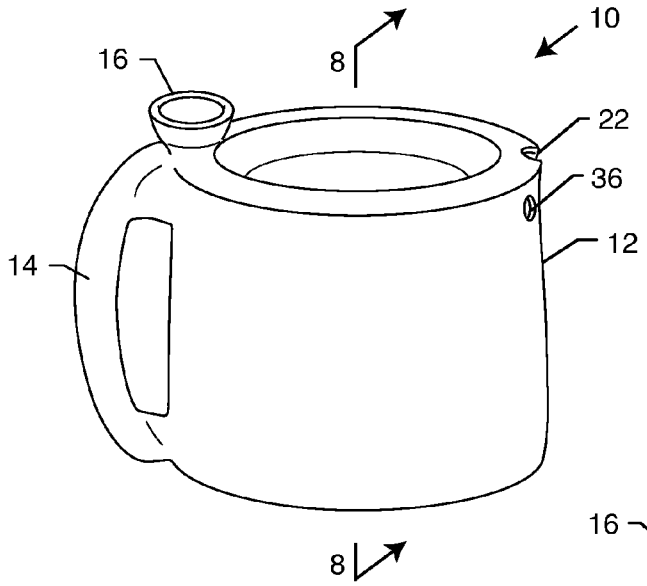
FIG. 7 is a perspective view of an alternative pipe mug.
Figure 8:
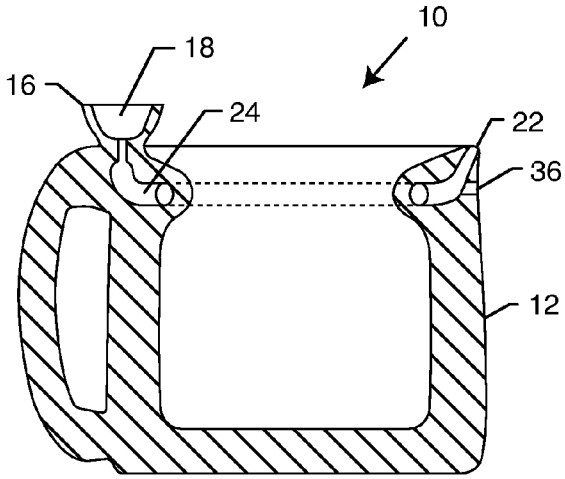
FIG. 8 is a cross-sectional view of the alternative pipe mug, taken about the line 8-8 in FIG. 7.
Figure 9:
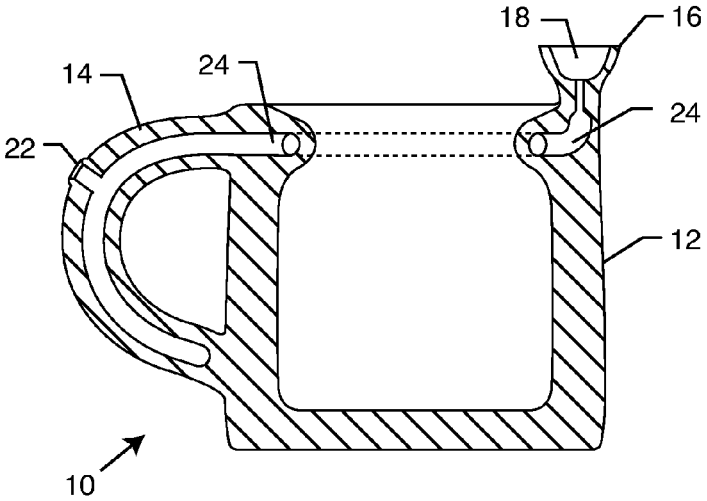
FIG. 9 is a cross-sectional view similar to FIG. 8, illustrating a hollowed out handle.
Figure 10:
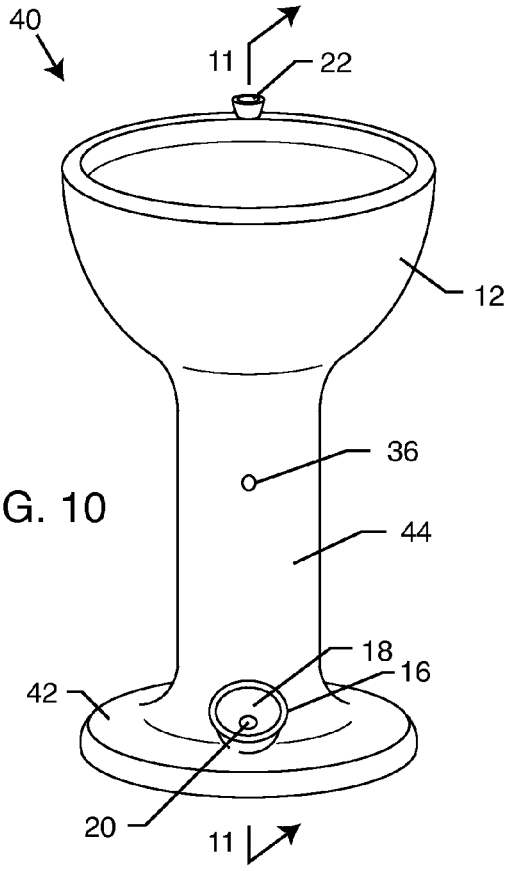
FIG. 10 is a perspective view of an alternative combination smoking and drinking apparatus in the form of a wine goblet.

FIGS. 7-9 illustrate another alternative embodiment of the pipe mug 10. Like the embodiments described above, FIG. 7 illustrates the container 12, the handle 14, the bowl 16, the mouthpiece 22 and the carb 36. In this embodiment, the bowl 16 is positioned adjacent the handle 14 and the mouthpiece 22 is opposite thereof, as shown. FIG. 8 more specifically shows the interior structure of the pipe mug 10 depicted in FIG. 7. Again, tobacco is loaded into the compartment 18 of the bowl 16. After the tobacco is ignited, the user may draw smoke through the conduit 24 coupled to the compartment 18 of the bowl 16. The smoke travels around the exterior of the container 12 to exit through the mouthpiece 22. The conduit 24 may be formed around the entire perimeter of the container 12 or around just a portion of the container 12. In the embodiment wherein the conduit 24 travels around the entire perimeter of the container 12, the carb 36 may be disposed on either side of the bowl 16. Furthermore, a consumable beverage may be poured into and consumed out of the container 12. The hollow double wall construction of the container 12 prevents cross-contamination between the beverage and the smoke traveling through the conduit 24.

FIG. 9 illustrates an alternative embodiment of the pipe mug 10 shown with respect to FIG. 8. In this embodiment, the bowl 16 is coupled with the conduit 24 on an opposite side of the handle 14. Instead of locating the mouthpiece 22 along the perimeter of the container 12, here the mouthpiece 22 is coupled to the handle 14. As such, the elongated conduit 24 extends from bowl 16 at one end, around a portion of the container 12, and into the handle 14 to be coupled with the mouthpiece 22 at the other end. Similar to the other embodiments, users inhale smoke by burning tobacco in the compartment 18 of the bowl 16 and creating a vacuum at the mouthpiece 22 by inhaling. Smoke from the bowl is drawn into the conduit 24, around the perimeter of the container 12 and out through the mouthpiece 22 in the handle 14. Preferably, the bowl 16 is positioned across from the mouthpiece 22, as shown in FIG. 9, to enhance visibility.

FIGS. 10-14 illustrate a goblet 40 in accordance with another embodiment of the combination smoking and drinking apparatus. The goblet 40 includes a base 42, a stem 44 and the container 12. The bowl 16 is preferably built into the base 42. The aperture 20 therein provides access to an interior chamber 45 (FIGS. 11 and 13) in the stem 44. Smoke in the interior chamber 45 travels to the mouthpiece 22 through one or more vents that couple the interior chamber 45 to the conduit 24. The carb 36 is preferably located toward the top portion of the stem 44. Although the carb 36 may be located virtually anywhere between the bowl 16 and the mouthpiece 22. Preferably, the mouthpiece 22, the carb 36 and the bowl 16 are located in a direct line of sight (e.g., in a common plane) of one another to enhance ergonomics, such as facilitating left or right-handed use of the goblet 40. Additionally, aligning the mouthpiece 22, the carb 36 and the bowl 16 provides greater visualization of the bowl 16 when the user endeavors to ignite tobacco within the compartment 18. It is preferred that the user be able to see the mouthpiece 22 and the bowl 16 while smoking from the mouthpiece 22. Furthermore, the carb 36 should also be in a comfortable location while the user utilizes the goblet 40 as a smoking device.

Figure 11:
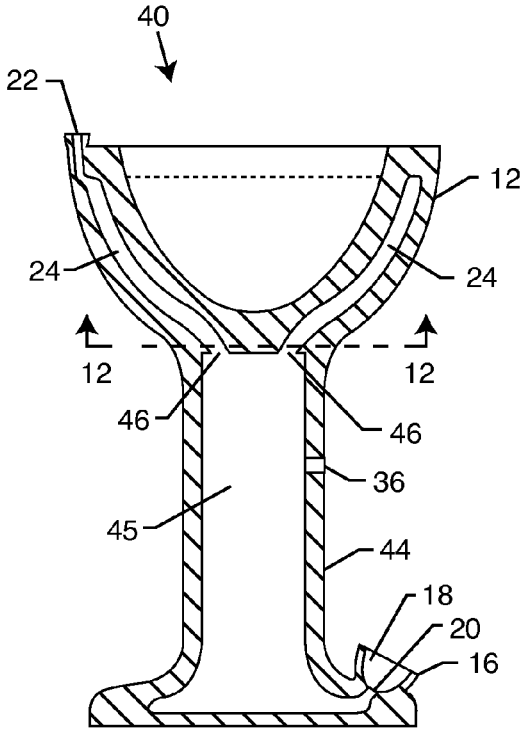
FIG. 11 is a cross-sectional view of the wine goblet, taken about the line 11-11 in FIG. 10.
Figure 12:
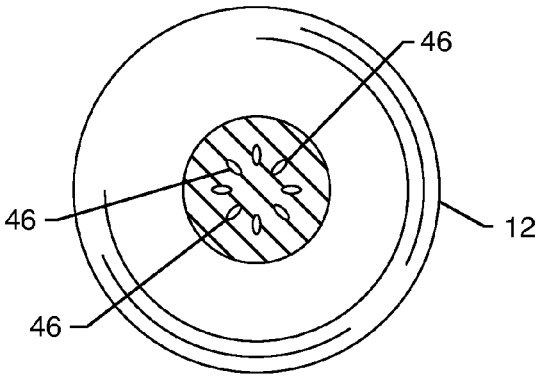
FIG. 12 is a bottom view taken about the line 12-12 in FIG. 11, illustrating a set of vents permitting smoke to pass from the stem to the beverage container.

FIG. 11 illustrates a cross-sectional view of the goblet 40. As shown, the bowl 16 is formed at the base 42 of the goblet 40. Smoke is drawn through the aperture 20 and into the interior chamber 45 of the stem 44 for travel through one of a plurality of the vents 46 (best shown in FIG. 12) and into the conduit 24. The user is then able to inhale the smoke through the mouthpiece 22. The carb 36 acts as a passive air flow device so that the user is able to inhale all of the smoke within the interior chamber 45 of the stem 44. Of course, smoke that enters the conduit 24 from the stem 44 does so without entering the container 12, which holds a consumable beverage. In this respect, the smoke may travel in and around the container 12 as part of the double-walled construction that forms the conduit 24 therearound, without cross-contamination of the smoke with the consumable beverage. FIG. 12 more specifically illustrates the vents 46, which allow smoke to travel into the conduit 24 without actually contaminating the container 12.

Figure 13:
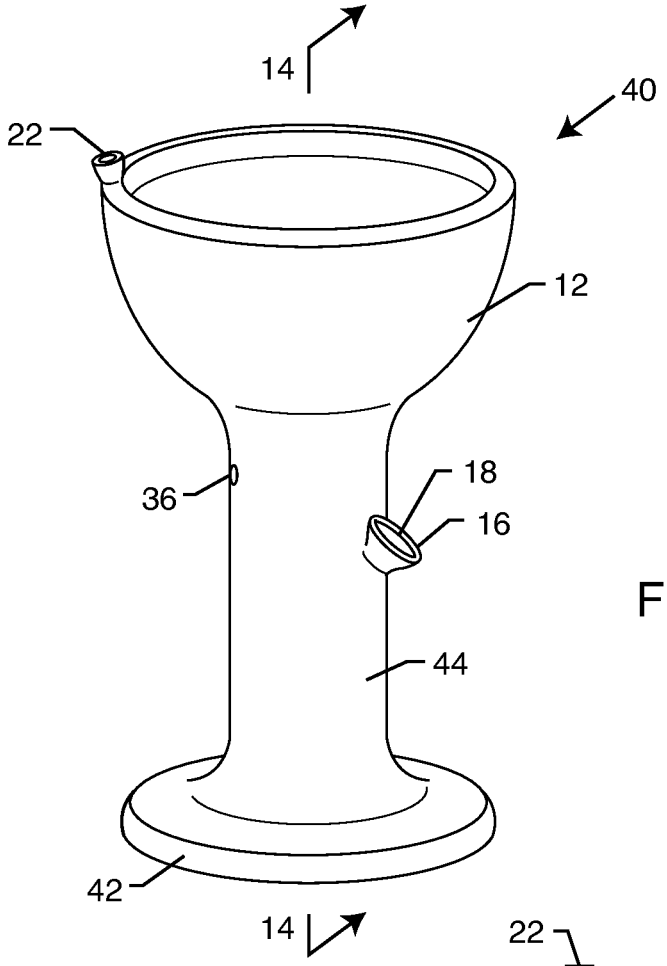
FIG. 13 is a perspective view of an alternative wine goblet, illustrating the bowl placed midway up the stem.
Figure 14:
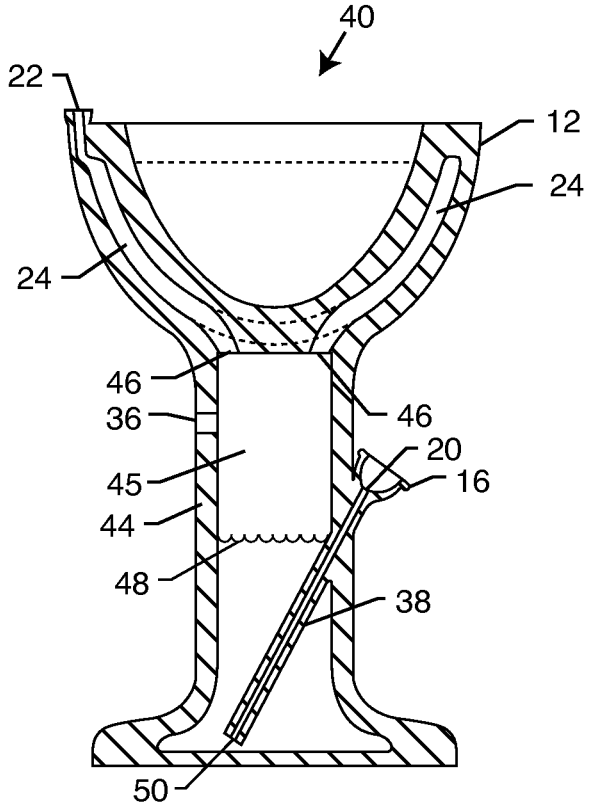
FIG. 14 is a cross-sectional view of the alternative wine goblet, taken about the line 14-14 in FIG. 13.

In the version shown with respect to FIG. 11, no water is needed. But, FIGS. 13-14 illustrate an alternative embodiment wherein the goblet 40 can be used with water. As such, a quantity of water is filled within the interior chamber 45 of the stem 44 as shown by a water line 48 (FIG. 14). In this embodiment, the bowl 16 includes the elongated shaft 38 that extends into the water reservoir within the interior chamber 45 of the stem 44. The embodiment shown with respect to FIGS. 13 and 14 operates substantially similar to the other embodiments described above. That is, a user places tobacco or another substance to be smoked in the bowl 16. The substance is ignited and smoke is drawn into the shaft 38 of the bowl 16 through the aperture 20 therein. Smoke travels through the shaft 38 and out through an exit aperture 50 disposed within the water reservoir in the stem 44. This causes percolation. Additionally, the water tends to clarify any contaminants in the smoke before it reaches the mouthpiece 22. As such, smoke entering the water from the exit aperture 50 travels upwardly through the vertical part of the stem 44 toward the vents 46. Smoke travels through the vents 46 and into the conduit 24 before being inhaled by the user through the mouthpiece 22. The smoke drawn through the goblet 40 is maintained in a separate chamber from any consumable beverage within the container 12. The embodiments described with respect to FIGS. 10-14 may also be used in champagne glasses, wine glasses, or other beverage containers of similar shape and construction.

Figure 15:
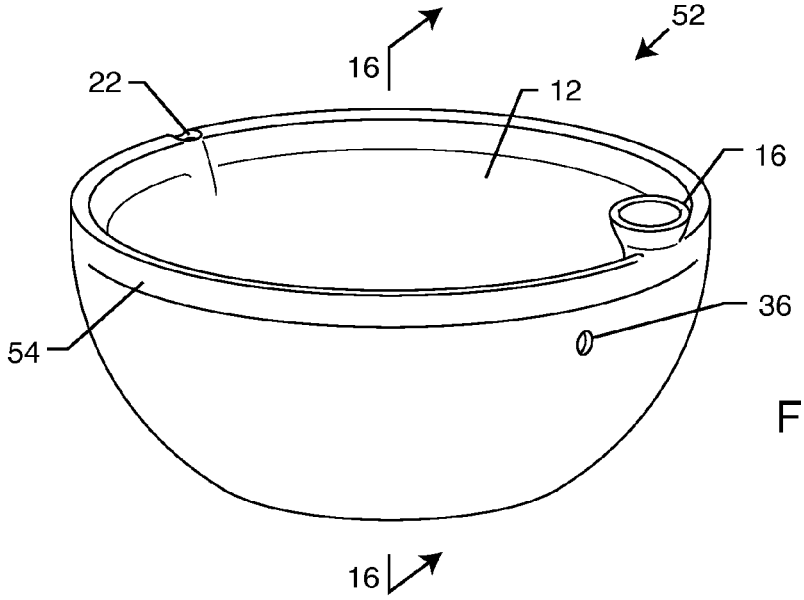
FIG. 15 is a perspective view of an alternative combination smoking and drinking apparatus in the form of a dish.
Figure 16:
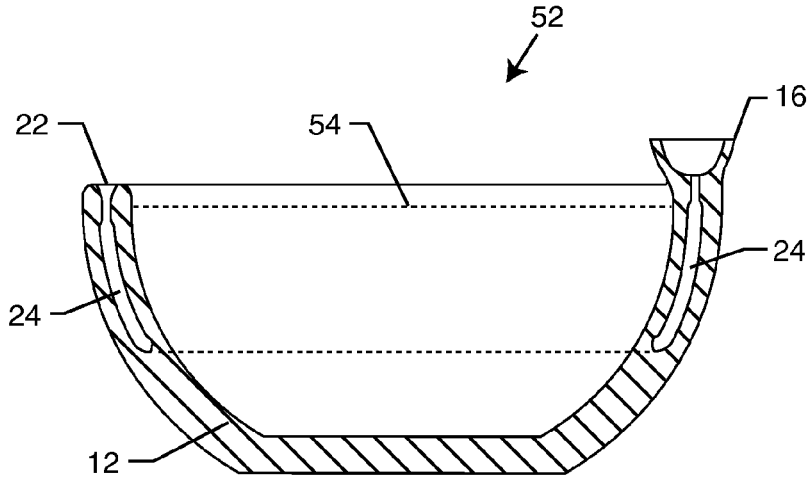
FIG. 16 is a cross-sectional view of the dish, taken about the line 16-16 in FIG. 15.
Figure 17:
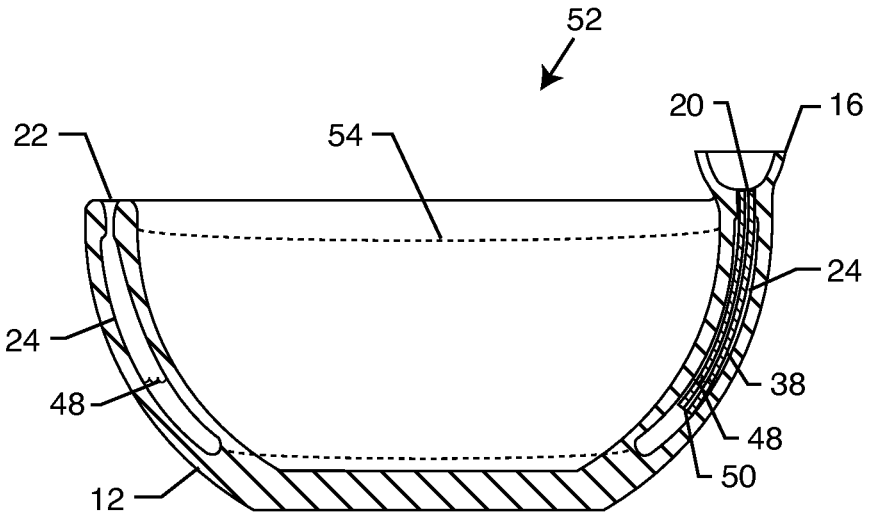
FIG. 17 is an alternative cross-sectional view of the dish, illustrating a shaft disposed in a water reservoir to percolate smoke before inhalation.

FIGS. 15-17 illustrate another alternative embodiment of the combination smoking and drinking apparatus in the form of a dish 52. FIG. 15 is a perspective view of the dish 52 illustrating the bowl 16 formed from a rim 54 thereof and the carb 36 nearby. The carb 36 provides access to the conduit 24 in accordance with the embodiments described above. The mouthpiece 22 is preferably formed at an opposite side of the rim 54 as the bowl 16 and the carb 36. This design enhances the usability of the dish 52 because the user is able to inhale smoke through the mouthpiece 22 while retaining a clear line of sight to the bowl 16 while, at the same time, being able to operate the carb 36 with either the left-hand or right-hand. As with the other embodiments described above, the dish 52 includes the container 12 for storing a consumable beverage or for containing a food product such as soup or cereal. A person of ordinary skill in the art will readily recognize that the container 12 could be used to contain virtually any type of consumable food or beverage product. The convenience of this embodiment is that, for example, a user may be able to eat cereal and smoke from the dish 52, without needing a separate smoking device.

FIG. 16 is a cross-sectional view that more specifically illustrates the internal compartments of the dish 52. For example, FIG. 16 illustrates the bowl 16 coupled to the conduit 24 at one end and the mouthpiece 22 coupled to the conduit 24 at the other end. The conduit 24 is preferably sealed off from within the interior of the container 12 such that smoke inhaled through the mouthpiece 22 does not contaminate or otherwise mix with the contents of the container 12. As with the embodiments described above, the conduit 24 may be formed partially or wholly around the exterior perimeter of the container 12. As shown in FIG. 16, the conduit 24 extends approximately half way down the height of the container 12. Alternatively, the conduit 24 may include a single small ring, such as around the rim 54 (similar to that shown in FIG. 8) or the conduit 24 may fully encompass the height of the container 12 (similar to that shown in FIG. 6). Smoke inhaled through the aperture 20 travels through the conduit 24 around the exterior of the container 12 and out through the mouthpiece 22 to be inhaled by the user.

The materials used to make the combination smoking and drinking apparatus disclosed herein could include ceramics, glass, porcelain, stainless steel (or another alloy), plastic, etc. The combination smoking and drinking apparatus may also be made out of many other different shapes, sizes or forms. Other embodiments may include sports bottle pipes, cereal bowl pipes, planter (e.g., a pot or container) pipes, etc. Each of said embodiments will generally utilize the above-identified combination of the container 12, the bowl 16, the mouthpiece 22 and the conduit 24 to provide a combination smoking and drinking apparatus. Additionally, the combination smoking and drinking apparatus may include insulation to prevent heat transfer between the container 12 and the conduit 24. In this respect, the combination smoking and drinking apparatus may be made from materials that naturally insulate heat transfer. In another embodiment, the container 12 or the conduit 24 may be lined with an insulative material that likewise prevents heat transfer. The insulative material may also be disposed between adjacent portions of the container 12 and the conduit 24. Preventing heat transfer may be important in two respects: (1) preventing smoke travelling through the conduit 24 from becoming uncomfortably hot or cold as a result of heat transfer with a hot or cold beverage in the container 12; and (2) preventing smoke (and other air flow) within the conduit 24 from having a warming or cooling effect on a cold or hot beverage in the container 12. The important aspect is that the beverage in the container 12 and the smoke travelling through the conduit 24 do not cross-contaminate one another (whether through particulates or heat transfer). Additionally, the carb 36 is an optional component that may or may not be used with any of the embodiments described herein.

Figure 18:
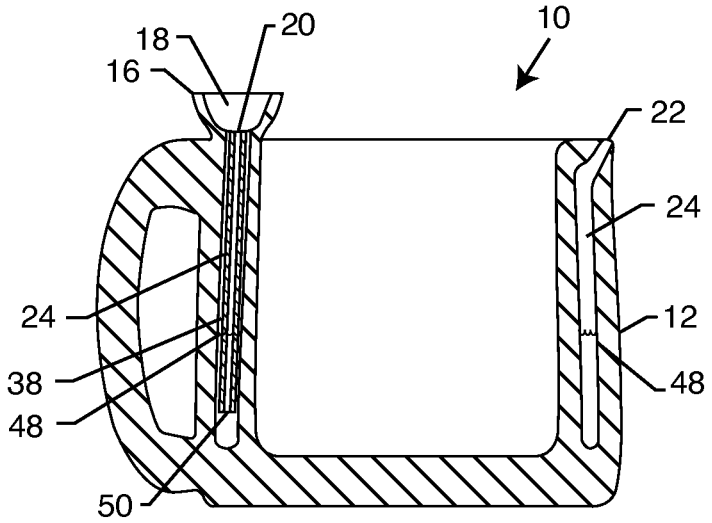
FIG. 18 is an alternative cross-sectional view of the pipe mug of FIGS. 7-9, illustrating the use of the shaft and water reservoir to cool and percolate smoke before inhalation.

FIGS. 17 and 18 illustrate alternative embodiments of the dish 52 and the pipe mug 10 for use with water percolation, similar to the embodiment described with respect to the goblet 40 in FIGS. 13-14. In FIG. 17, the bowl 16 includes the elongated shaft 38 that extends into the conduit 24 underneath the water line 48. In this embodiment, the conduit 24 is partially filled with water up to the water line 48, thereby forming a water reservoir. The water line 48 is positioned so the exit aperture 50 of the shaft 38 is fully immersed within the water. Burning tobacco in the bowl 16 enables a user to draw smoke through the aperture 20 down into and through the shaft 38 and into water. The water cools the smoke as it travels therethrough before percolating out back into the air space above the water line 48 in the conduit 24. This is the smoke that the user inhales through the mouthpiece 22 at an opposite end of the dish 52. Preferably, the conduit 24 is only partially filled with water so that the user does not inadvertently inhale water through the mouthpiece 22.

FIG. 18 is an alternative cross-sectional view of the pipe mug 10, utilizing the water percolation system previously described with respect to FIG. 17. As shown in FIG. 18, the pipe mug 10 includes the bowl 16 having the shaft 38 that extends below the water line 48. The water line 48 represents the top of a water reservoir disposed within the conduit 24. Similar to FIG. 17, tobacco is placed within the compartment 18 of the bowl 16. The tobacco is ignited and begins to burn. A user inhales at the mouthpiece 22 at an opposite end of the pipe mug 10. Smoke is drawn from the burning tobacco in the compartment 18, through the aperture 20 and into the shaft 38. The shaft 38 terminates at the exit aperture 50 beneath the water line 48. As a result, smoke drawn through the exit aperture 50 enters the water within the conduit 24. The smoke is forced to travel through and percolate out from the water.

One byproduct of this feature is that the water in the conduit 24 cools the smoke as it percolates therethrough. The water line 48 is preferably disposed far enough below the mouthpiece 22 such that inhalation does not result in accidently drawing water up through the mouthpiece 22. As such, it is preferred that the water line 48 be disposed approximately half way between the bottom of the container 12 and the mouthpiece 22.

Although several embodiments have been described in detail for purposes of illustration, various modifications may be made without departing from the scope and spirit of the invention. Accordingly, the invention is not to be limited, except as by the appended claims.

What is claimed is:

1. A combination smoking and drinking apparatus, comprising:

a generally upright consumable liquid retaining container;

an elongated conduit formed between an inner and an outer wall of the container, wherein the container is insulated from the elongated conduit;

an inlet coupled to one end of the conduit and having a combustion compartment; and an outlet coupled to an opposite end of the conduit such that applying a vacuum to the outlet pressurizes the conduit and draws smoke from the combustion compartment directly through the conduit to the outlet without mixing the smoke with the consumable liquid in the container.

2. The apparatus of claim 1, wherein the conduit comprises a non-liquid retaining conduit.

3. The apparatus of claim 2, wherein the inlet or the outlet is substantially positioned in a common plane with the container.

4. The apparatus of claim 1, including a stem coupled to the inlet and generally extending into the conduit.

5. The apparatus of claim 4, wherein the stem extends into a water reservoir selectively disposed at least partially within the conduit.

6. The apparatus of claim 1, wherein the outlet comprises a mouthpiece formed from a lip of the container.

7. The apparatus of claim 1, including a handle coupled to the container and having an elongated passageway bridging the inlet and the outlet via the elongated conduit.

8. The apparatus of claim 7, wherein the outlet is externally accessible from the handle.

9. The apparatus of claim 1, wherein the inlet and the outlet are located on opposite sides of the container.

10. The apparatus of claim 1, including a carb formed from an exterior portion of the container and coupled to the conduit, thereby selectively exposing the conduit to atmospheric pressure.

11. The apparatus of claim 1, including a bowl selectively insertable into the inlet.

12. A combination smoking and drinking apparatus, comprising:

an upright base;

a consumable liquid retaining container coupled to and generally positioned above the base, the container having a double-walled construction defining a conduit, wherein the container and the conduit are insulated from heat transfer;

an externally accessible outlet coupled the container; and an inlet formed from a portion of the base and including a combustion compartment, the conduit forming an elongated and narrow passageway directly connecting the inlet and the outlet, wherein applying a vacuum to the outlet pressurizes air within the conduit and draws smoke from the combustion compartment through the conduit to the outlet without mixing the smoke with the consumable liquid in the container.

13. The apparatus of claim 12, wherein the inlet comprises a bowl having a stem disposed therein and extending into the interior chamber of the base.

14. The apparatus of claim 13, wherein the stem is sized to extend into a water reservoir in the interior chamber.

15. The apparatus of claim 12, wherein the interior chamber comprises a generally elongated tunnel coupled to an elongated conduit by the at least one vent.

16. The apparatus of claim 12, including an externally accessible carb positioned between the inlet and the outlet, thereby selectively exposing the interior chamber or the conduit to atmospheric pressure.

17. The apparatus of claim 15, wherein the carb, the inlet and the outlet are positioned in a common plane.

18. The apparatus of claim 12, wherein the apparatus comprises a wine goblet.

19. A combination smoking and drinking apparatus, comprising:

a generally upright consumable liquid retaining container;

an elongated non-liquid retaining conduit formed between an inner and an outer wall of the container, wherein the elongated conduit is thermally insulated from the container;

an inlet coupled to one end of the conduit and having a combustion compartment;

an outlet coupled to an opposite end of the conduit such that applying a vacuum to the outlet pressurizes the conduit and draws smoke from the combustion compartment directly through the conduit to the outlet without mixing the smoke with the consumable liquid in the container;

a handle coupled to the container and having an elongated passageway bridging the inlet and the outlet via the elongated conduit, wherein the outlet is externally accessible via the handle; and a carb formed from an exterior portion of the container and coupled to the conduit, thereby selectively exposing the conduit to atmospheric pressure.

* * * * *